US007413504B2

(12) United States Patent
Lytinas

(10) Patent No.: US 7,413,504 B2
(45) Date of Patent: Aug. 19, 2008

(54) BLADE SHARPENING DEVICE WITH BLADE CONTOUR COPYING DEVICE

(76) Inventor: Michael Lytinas, 62 Boylston St. #109, Boston, MA (US) 02116

( * ) Notice: Subject to any disclaimer, the term of this patent is extended or adjusted under 35 U.S.C. 154(b) by 0 days.

(21) Appl. No.: 11/836,436

(22) Filed: Aug. 9, 2007

(65) Prior Publication Data

US 2008/0096477 A1 Apr. 24, 2008

Related U.S. Application Data

(60) Provisional application No. 60/852,940, filed on Oct. 20, 2006.

(51) Int. Cl.
*B24B 3/00* (2006.01)

(52) U.S. Cl. ..... 451/67; 451/45; 451/237; 451/296; 451/312

(58) Field of Classification Search ..... 451/45, 451/66, 185, 187, 192, 193, 196, 198, 202, 451/203, 205, 206, 208, 224, 229, 234, 248, 451/293, 321, 367, 371, 237, 238, 281, 299
See application file for complete search history.

(56) References Cited

U.S. PATENT DOCUMENTS 4,144,678 A * 3/1979 Ellwanger et al. ..... 451/48
5,390,431 A 2/1995 Friel
5,480,343 A * 1/1996 Pedersen et al. ..... 451/10
5,480,345 A * 1/1996 Bethea ..... 451/234
5,897,428 A * 4/1999 Sakcriska ..... 451/202
6,629,875 B2 * 10/2003 Steere, III ..... 451/9
6,726,551 B2 4/2004 Friel, Sr.
7,112,124 B1 * 9/2006 Naples ..... 451/279

* cited by examiner

*Primary Examiner*—Timothy V Eley
(74) *Attorney, Agent, or Firm*—Barlow, Josephs & Holmes, Ltd.

(57) ABSTRACT

The present invention provides a blade sharpening device designed for sharpening a blade for a uniform sharpening of the edge thereof. The blade sharpening device contains a base having a guide slidably movable relative to the base. The guide includes a material that receives an impression of a blade defining a blade contour. A blade holder is attached to the base for securing the blade while being sharpened. A carriage contains an elongated structure for interacting with the material of the guide which has received an impression of the blade defining a blade contour. The guide defines a sharpening path substantially aligning with the blade contour. The carriage also has an abrasive surface for sharpening the blade. In operation, the guide and carriage direct the movement of the abrasive surface along the contour of the blade for a uniform sharpening of the edge thereof.

17 Claims, 7 Drawing Sheets

BLADE SHARPENING DEVICE WITH BLADE CONTOUR COPYING DEVICE

CROSS-REFERENCE TO RELATED APPLICATION

This application is related to and claims priority from earlier filed provisional patent application Ser. No. 60/852,940, filed Oct. 20, 2006.

BACKGROUND OF THE INVENTION

The present invention generally relates to blade or knife sharpening devices. More specifically, the present invention relates to a blade sharpening device that can sharpen blades to provide a consistent and uniform angle along the edge of the blade.

In the industry, it is well known to sharpen blades using a blade sharpening device. Several industries and persons require a sharp blade in their business operations: knife sharpeners, chefs, knife retailers, military, knife manufacturers, restaurants, knife distributors, hardware retailers, cutlery retailers, hardware wholesalers, cutlery wholesalers, agriculture, knife collecting clubs, landscapers, farmers/harvesters, hunters, lawn mower retailers, fishermen, outdoor products distributors, woodworkers, handymen, law enforcement, police, campers, tool retailers, house painters, automotive painting, carpet Installers, upholstery, linoleum installers, winery (pruning), and gardeners.

In order to sharpen a blade, the following issues must be addressed: the angle of the grinding medium to the edge of the blade, the path that the grinding medium follows, consistency of the above two factors throughout the sharpening course, the shape of the grinding medium, and the temperature of the blade during sharpening.

One method of blade sharpening involves using a grinding medium and the skill of the user. The main purpose of the grinding medium is to use something harder than the metal of the blade and grind the blade against it, manually, with little assistance to the user in controlling the angle of the blade. This grinding medium typically consists of grinding stones made of diamond, silicon carbide, aluminum oxide, soft and hard Arkansas, ceramic, and Japanese water stones.

The drawback to using a grinding medium without further assistance is the skill required by the user is an art that is difficult to obtain for ordinary users of the grinding medium. It can produce excellent results provided that the user has the proper know-how and proper coordination. Attempting to sharpen a blade without the proper technique can result in permanent damage of the blade. Sharpening by hand is not for the amateur and it is best when performed by professional knife sharpeners.

Another drawback to this method of sharpening is the time and effort involved in sharpening blades. The user must grind the blade against the stone several times in order to "raise a burr", the sign that a side of the edge is sharpened. The same procedure must be done on the other side of the blade. Using stones of different grits multiplies the process by several times. Typically, at least two grits of stone and a honing/polishing must be used to properly sharpen a dull blade. This process requires at least 10-20 minutes per blade.

Other methods of blade sharpening address how to maintain a proper angle of the blade against the grinding medium. This category includes several types of devices such as guides, rod guides, crock sticks, slot gadgets, slide sharp, Skarb® system, and warthog system. Each of these devices will be described in further detail below.

Guides, such as the Buck Hone Master® and Razor® edge, assist the user in maintaining the proper angle of the blade to the grinding medium. The drawbacks are that the guides do not make use of the entire stone, the guide degrades during the sharpening process, and the path of the blade is still directed by the user which requires sufficient skill. In addition, it has many of the drawbacks discussed in the grinding medium above.

Rod-guided systems, such as Lansky®, GATCO®, Edge Pro Apex®, and DMT® systems, assist the user to maintain the angle of the blade to the grinding medium. More specifically, it is optimal for use of smaller sized blades. However, it has similar drawbacks featured in the guides and the grinding medium above.

Crock sticks, such as the Spyderco® system, Lansky® system, and Warthog® system, are another type of rod-guided system. With this system, the rods are held in a "V" at a predetermined angle and the blade is brought down against them in a slicing motion. It is another manual sharpening system and the user can make deviations from the set angle by tilting the blade. The drawback to this system is the rods are in a predetermined angle that the user will find difficult to adjust. It also has all the drawbacks of the previously mentioned rod-guided systems.

Slot gadgets, such as the Meyerco Sharpen-It System® and the Normark® sharpener, assist the user to maintain the angle of the blade relative to the grinding medium. With the slot gadgets, the user draws the blade through a slot a few times and this motion sharpens the blade. The drawback of these gadgets is that sometimes they damage the blade. When the slot gadget utilizes wheels, the blade changes shape over time. In addition, the overall quality of the sharpened blade is low.

The Skarb® system is a guide holding the blade in place while this system pivots on a vertical rod. It is a variation on the rod guided systems with low quality results since the angle is not kept the same throughout the blade (from 17 up to 30 degrees to the tip). Also, the Slide® sharp from CRKT® is another variation of the rod guided system having similar problems as the Skarb® (holding the angle throughout the blade).

Another method of sharpening blades involves the usage of power sharpeners. As in manual sharpening, power sharpening can be assisted or unassisted. Unassisted power sharpening involves, for example, two electric sharpeners—a belt sander and a bench grinder. With these electric sharpeners, the user passes the blade against the stone or the belt a few times to sharpen it. Sharpening blades with these two machines requires experience and skill. The belt sander or the stones are aggressive grinding mediums that can damage a blade in an unskilled user.

Assisted power sharpening is popular among both amateurs and professionals alike. The grinding medium is still a stone or a sand paper but the machines are outfitted with several guides or jigs to maintain a constant angle of the blade and guide the user for the proper sharpening. Two examples of assisted power sharpening are the Makita® and the Delta® with guides that help the user to adjust and keep the desired angle of the blade to the grinding medium.

Another two examples of assisted power sharpening are the Edge Craft's Chef® and the Fire Stone® from McGowan®. In this case, both machines use diamond hones for sharpening but the difference from the Makita® and the Delta® is that they have a guide that holds the blade in place so that the user does not wobble the blade during sharpening. They both have predetermined angles and three sets of wheels, two for sharpening and one for polishing/honing. The user makes a few passes from one slot to the other up to the polishing stage. These machines sometimes fail to produces a sharp edge on the blade and can scratch the sides of the blade.

On the professional grade, there are several types of sharpening systems. The Friedrich Dick® model, the True Hone® model, the Hook-Eye® belt grinder, and the Chef's Choice® professional are a few examples of some professional grade blade sharpening systems. Not all of them consistently create a razor edge on a blade. The machines are manufactured mainly for the purposes of a professional sharpener. Consequently, these devices still require some a skilled user for operation.

Finally, the Tormek® system uses a wet wheel and several guides and jigs for sharpening knives. It has a fully adjustable angle maker that sets the desired angle. It can grind out nicks or reshape broken tips without overheating the blade. It is an expensive tool designed for professional use. The jigs are sold separately, making it even more expensive.

In the prior art, the user's skill and "feeling" of the sharpening is paramount. The "art" part of the sharpening is still present in all of these prior art blade sharpening devices. The present invention solves the above problems in the prior art which results in a consistent, accurate and controlled process for sharpening with minimal user skill required. More importantly, the present invention directs a sharpening path of along a contour of the blade against an abrasive surface, with minimal user input. The present invention brings professional grade sharpening of the blade to the unskilled user with consist and uniform sharpening of the edge.

SUMMARY OF THE INVENTION

An embodiment of the present invention preserves the advantages of prior blade sharpening devices. In addition, it provides new advantages not found in currently available blade sharpening devices and overcomes many disadvantages of such currently available blade sharpening devices.

The present invention provides a blade sharpening device designed for sharpening along the contour of the blade for a uniform sharpening of the edge thereof. The blade sharpening device includes a base containing a base holder for securing the blade during sharpening. A guide is positioned on the base for slidable movement relative to the base. The guide contains a material capable of receiving an impression of a blade. A carriage containing an abrasive surface for sharpening the blade follows along the material of the guide for sharpening the contour of the blade. The abrasive surface contacts the blade during the sharpening process to provide a uniform edge along a length of the blade.

The blade holder is a post attached to the base for securing the blade while being sharpened. The post is mounted on the base and is stationary. The post contains a vertical stabilizer and a scale for applying force. A user determines a desired height of the vertical stabilizer along the post by securing a screw mounted within the vertical stabilizer. The scale is connected to the post and the vertical stabilizer. In an alternative embodiment, the scale is connected to the post and the blade mount. The user determines a level of force with which the blade meets the abrasive surface of the carriage by adjusting the scale. In one embodiment, two scales may be used to apply force in an upward or downward direction. The vertical stabilizer consists of blade mount which has a clamp that secures the blade in a horizontal position relative to the post during sharpening. It should be appreciated that the scale can be substituted for another device which applies force to move the blade against the abrasive surface during sharpening.

The guide includes a material that receives an impression of a blade defining a blade contour. The guide consists of a top plate and bottom plate that contains material capable of receiving in impression of a blade contour. In one embodiment, the material is a series of metallic sheets, preferably thin. It is contemplated that materials other than metallic sheets, such as foam or rods, may be used create an impression of the blade. The sheets are placed in a vertical position adjacent to one another. Using a vice screw incorporated within a side of the guide, the sheets are controlled to move along an X axis. Once an impression of the contour of the blade is created within the sheets, the vice screw is adjusted to prevent the movement of the sheets along X axis. In addition, the bottom plate has wheels positioned along a bottom surface of the bottom plate to allow slidable movement of the guide along the top of the base.

A carriage is provided for slidable movement along the guide. The carriage consists of a mounting plate. The mounting plate contains at least one abrasive surface, a motor (not shown), and a handle for facilitating movement of the carriage relative to the guide. The abrasive surface contains at least one belt sander that rotates on at least one axle. The belt sander is powered by the motor (not shown).

In operation, the guide and carriage direct the movement of the abrasive surface along the contour of the blade for a uniform sharpening of the edge thereof. The blade is horizontally secured on the blade mount and the vertical stabilizer adjusts downward into a position opposite the sheets of the guide. The guide is moved along the base to until the sheets contact the blade. By applying additional force to the guide, the sheets conform to the contour of the blade and thus creating the impression of the blade's contour within the sheets. After the contour of the blade is transferred to the sheets, the sheets are secured in place by the vice.

Next, the vertical stabilizer adjusts upward into a position substantially above the guide. The carriage is subsequently placed upon the top of the guide for slidable movement. The sharpening angle of the carriage is adjusted by rotating the pivot structure. The vertical stabilizer is positioned downward to a position where the blade contacts the abrasive surface of the grinding medium. The scales on the blade holder are zeroed. After zeroing the scales, the vertical stabilizer is provided with a downward force. Consequently, the blade is pushed further against the abrasive surface. The force can be adjusted to prevent overheating or damage to the blade.

To begin, the lower edge of the blade is sharpened by tracking the carriage along the sheets of the guide. By rolling the carriage along the sheets of the guide, the blade is sharpened along a defined path similar to the contour of the blade. After sharpening the lower edge of the blade, the abrasive surface is pivoted to contact a top edge of the blade for sharpening similarly to the lower edge. As a result, the blade is sharpened with a consistent contour and edge. After sharpening, the blade is removed from the blade mount.

It is therefore an object of the blade sharpening device to provide consistency in both a contour and an edge of the blade during sharpening.

It is a further object of the blade sharpening device to reduce the skill required of a user to sharpen the blade. The device is operable by a professional or amateur with similar results.

It is a further object of the blade sharpening device to determine a specific angle throughout an edge of the blade.

Another object of the blade sharpening device is to prevent overheating of the blade during sharpening.

BRIEF DESCRIPTION OF THE DRAWINGS

The novel features which are characteristic of the blade sharpening device are set forth in the appended claims. However, the blade sharpening device, together with further embodiments and attendant advantages, will be best understood by reference to the following detailed description taken in connection with the accompanying drawings in which:

DETAILED DESCRIPTION OF THE PREFERRED EMBODIMENTS

Figure 1:
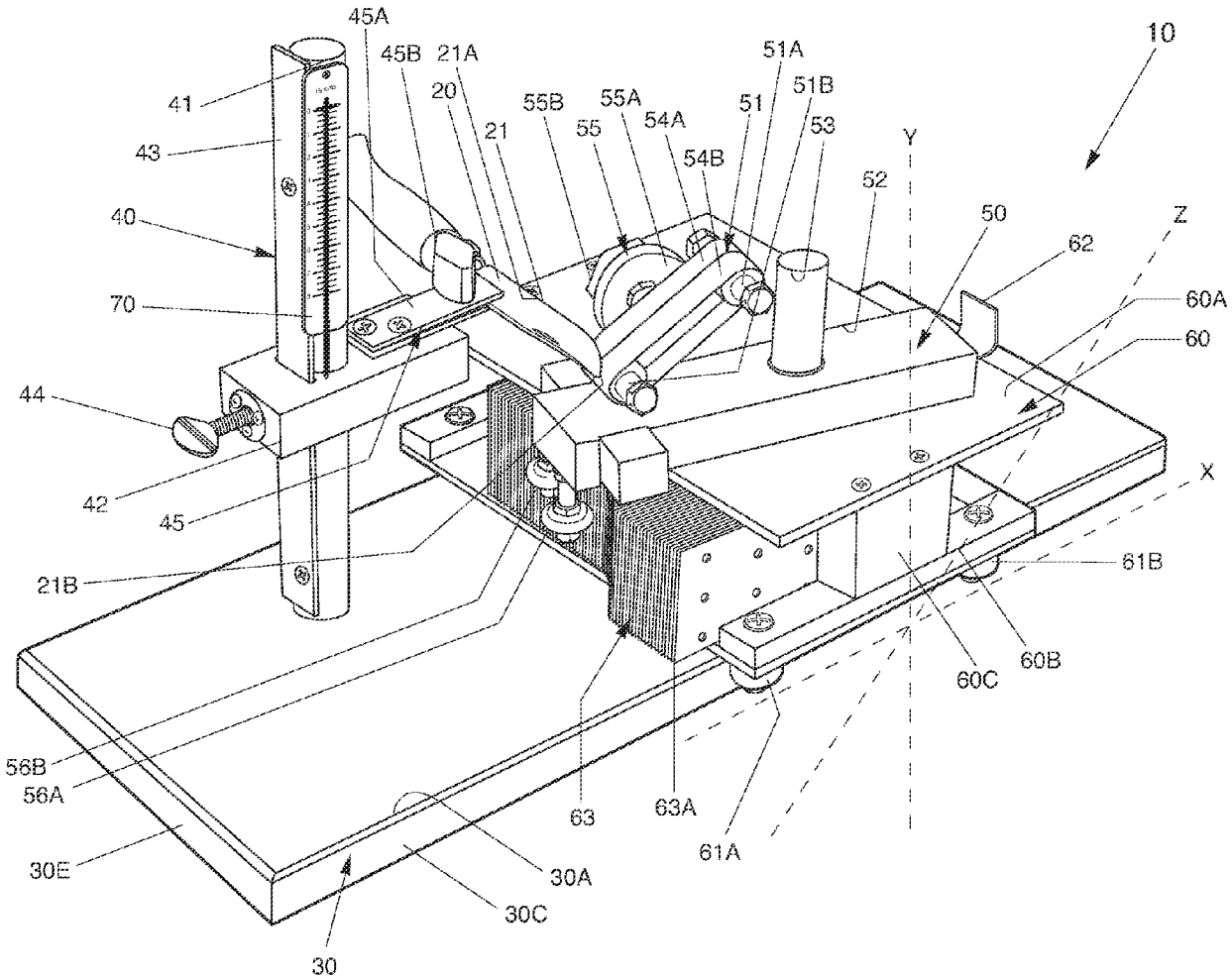
FIG. 1 is a front perspective view of a blade sharpening device of the present invention with an abrasive surface pivoted to sharpen a bottom edge of the blade.

The present invention solves the problems in blade sharpening devices by providing a new and unique construction for consistent and effective sharpening of blades. Generally, the present invention is a blade sharpening device 10 designed for sharpening a blade 20 for a uniform sharpening of the edge 21 thereof. Most importantly, the present invention provides a sharpening path defined by a contour of the blade 20 with minimal user input Now referring to FIG. 1, the blade sharpening device 10 is designed for sharpening the blade 20 for a uniform sharpening of the edge 21 thereof. The blade sharpening device 10 includes a rectangular shaped base 30 having a top 30A, bottom 30B, and four sides 30C-F.

The base 30 contains a blade holder 40 for securing the blade 20 during sharpening. The blade holder 40, in one embodiment, contains a post 41 attached to the base 30 for securing the blade 20 during the sharpening process. The post 41 extends vertically from the top 30A of the base 30 and is stationary. A vertical stabilizer 42 is slidably movable along the post 41. The user may control a desired height of the vertical stabilizer 42 at anytime. In one embodiment, the post 41 has a metal strip 43 on the post 41 to facilitate the movement of the stabilizer 42. An adjustable screw 44 is inserted through the vertical stabilizer 42 to contact the metal strip 43. When the screw 44 is sufficiently tightened, it fixes the vertical stabilizer 42 in a fixed position against the post 41.

The vertical stabilizer 42 also includes a blade mount 45 for securing the blade 20 in a fixed horizontal position. The blade mount 45 consists of a clamp 45A attached to the vertical stabilizer 42 that secures the blade 20 in a horizontal position relative to the post 41. The clamp 45A is designed to accommodate blades of varying sizes and depths. A user tightens or loosens the blade mount 45 by turning a tension knob 45B located within the blade mount 45.

Figure 2:
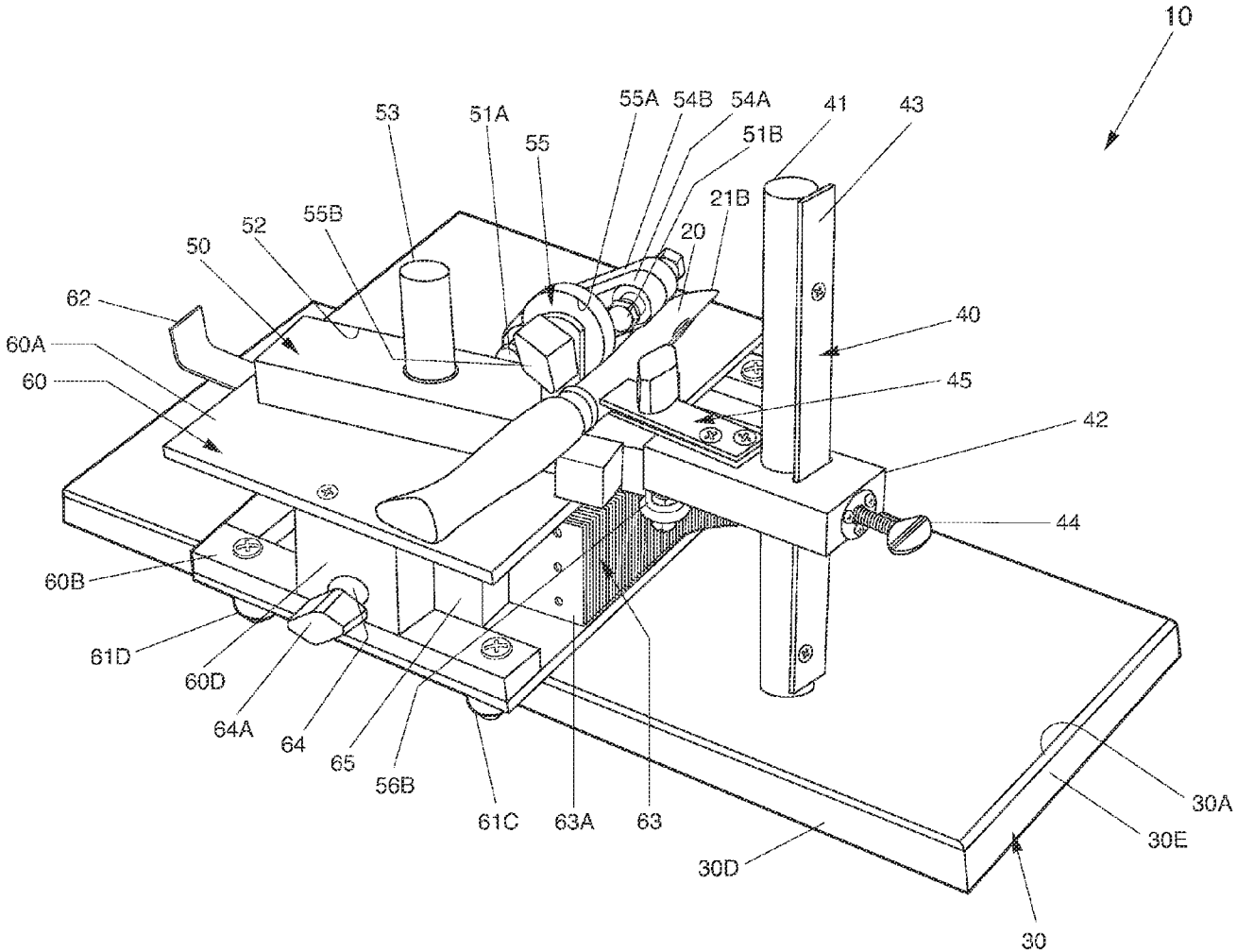
FIG. 2 is a rear perspective view of the blade sharpening device in FIG. 1 with an abrasive surface pivoted to sharpen a top edge of the blade.
Figure 3:
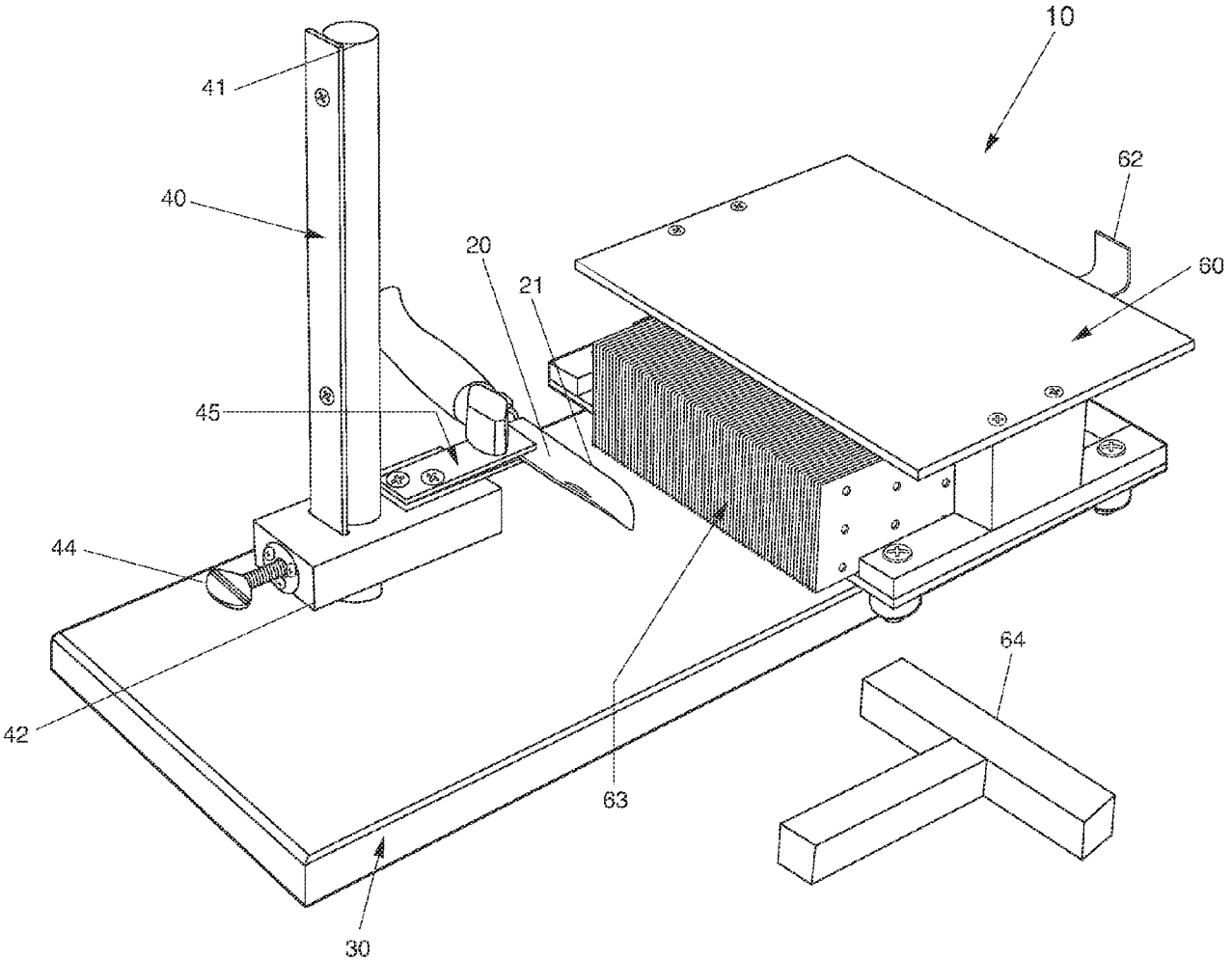
FIG. 3 is a front perspective view of the blade sharpening device in FIG. 1 without a carriage and before an impression of the contour of the blade is formed within the sheets of the guide.
Figure 4:
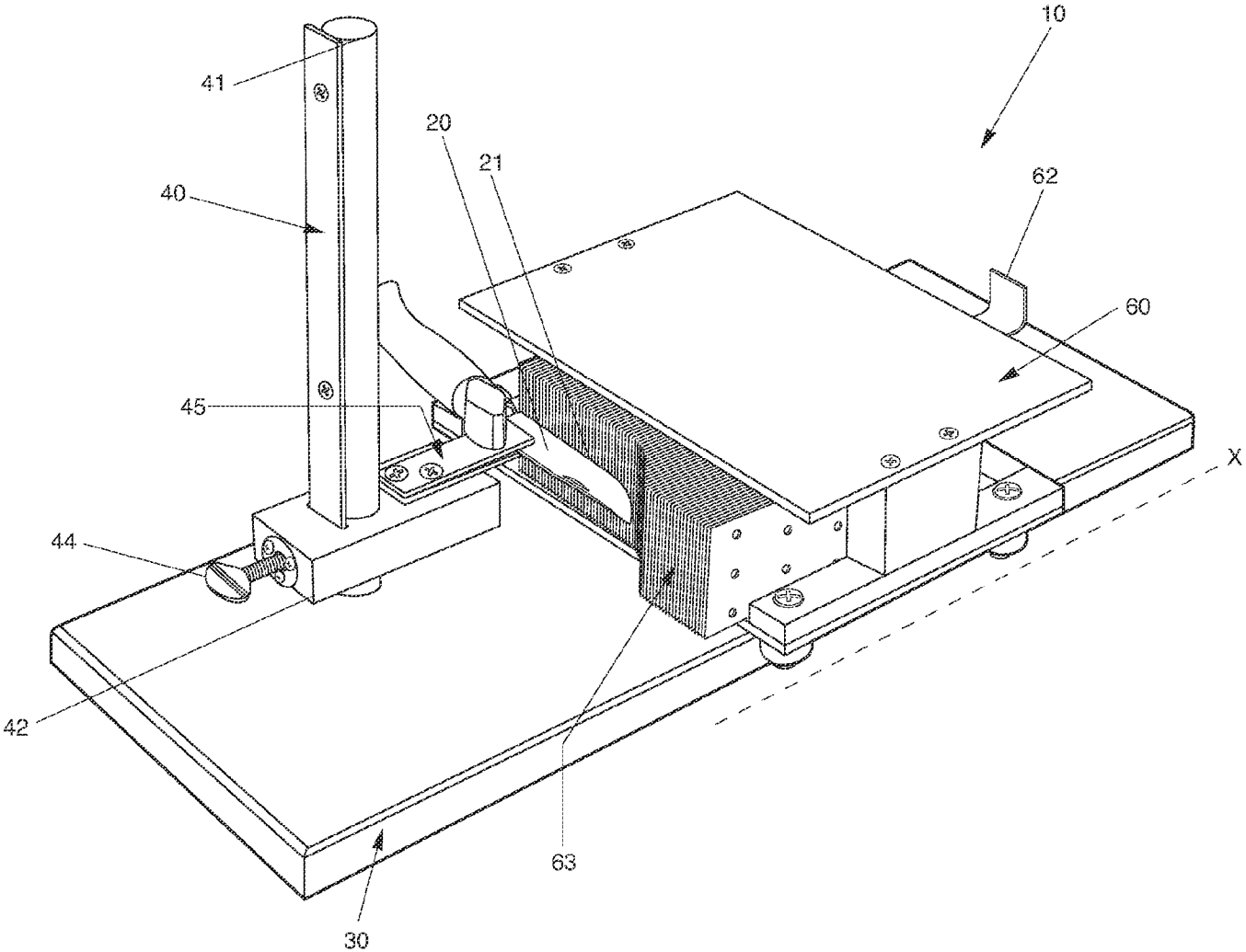
FIG. 4 is a front perspective view of the blade sharpening device in FIG. 1 without the carriage and with an impression of the contour of the blade being formed within the sheets of the guide.

The blade holder 40 also contains at least one scale 70 connected to the post 41 and to the vertical stabilizer 42. In an alternative embodiment, two scales 70 are connected to the post 41 and to the blade mount 45. A user may select the force applied by the scale 70 in either a downward or upward direction. The direction of the force is determined by whether a top edge 21A or a bottom edge 21B of the blade 20 is being sharpened. If the top edge 21A is being sharpened (as shown in FIG. 2), the force applied would be in the upward direction. If the bottom edge 21B is being sharpened (as shown in FIG. 1), the force applied would be in the downward direction. The level of force provided by the scale 70 determines the pressure on the blade 20 when it meets an abrasive surface 51 of a carriage 50, which is explained further below. It should be appreciated that the scale 70 can be substituted for another device which applies force to move the blade 20 against the abrasive surface 51 during sharpening.

A guide 60, in one embodiment, consists of a top plate 60A and a bottom plate 60B. The top plate 60A and the bottom plate 60B are connected by two sides 60C, 60D to form a shape of a box. In addition, the wheels 61A-D are attached to the bottom plate 60B to allow slidable movement of the guide 60 along the top 30A of the base 30. The wheels 61A-D substantially protrudes from the bottom plate 60B to contact the sides 30C, 30D of the base 30. Furthermore, a handle 62 is attached to the bottom plate 60B to facilitate the movement of the guide 60 relative to the top 30A of the base 30.

The guide 60 contains material capable of receiving an impression defining the contour of the blade 20. In one embodiment, the material is a series of metallic sheets 63, preferably with a small width. The sheets 63 are positioned between the top plate 60A and bottom plate 60B, which restricts the movement of the sheets 63 along a Y axis. The sheets 63 have a sufficient length capable of moving along an X axis in opposite correlation to the contour of the blade 20. The sheets 63 are vertically stacked between the sides 60C, 60D of the guide 60 to prevent any movement along the Z axis. In one embodiment, at least one hundred metallic sheets 63 are positioned between the sides 60C,60D. It is, however, contemplated that materials other than metallic sheets 63, such as memory foam or rods, may be used to create an impression by defining the contour of the blade 20.

Now referring to FIG. 2, a vice screw 64 is inserted through one side 60D of the guide 60 to contact a press plate 65 contacting the sheets 63. The vice screw 64 moves the press plate 65 relative to the sheets 63 to control their movement along an X axis and compact them against the other side 60C. When the vice screw 64 is loosened, it allows movement of the sheets 63 along the X axis. Once an impression of the contour of the blade 20 is defined within the sheets 63, the vice screw 64 is tightened to prevent the movement of the sheets 63 along the X axis. To assist the user, a knob 64A is attached to the vice screw 64 for manipulation by a user.

Now returning to FIG. 1, the carriage 50 is designed for slidable movement along the top plate 60A of the guide 60. In one embodiment, the carriage 50 is portable and free-standing. However, it is contemplated that the carriage 50 may be connected to the guide 60 or the base 30. The carriage 50 consists of a mounting plate 52. The mounting plate contains at least one abrasive surface 51, a motor (not shown), and a handle 53 for facilitating movement of the carriage 50 relative to the guide 60. The abrasive surface 51 contains at least one belt sander 54A, 54B that rotates on at least one axle 51A, 51B. The belt sander 54A, 54B is powered by the motor (not shown). In a preferred embodiment, there are two belt sanders 54A, 54B with two axles 51A, 51B containing sand paper of different grit—one paper for sharpening and the other paper for polishing the blade 20.

At least one axle 51A, 51B is connected to a pivot structure 55 for angling the abrasive surface 51 relative to the edge 21 of the blade 20. The pivot structure 55 contains a plate 55A connected to at least one axle 51A, 51B. A knob 55B for manipulation of the pivot structure 55 by a user is connected to the plate 55A. To angle the abrasive surface 51, the user turns the pivot structure 55 according to the respective need. If the top edge 21A (as shown in FIG. 2) or bottom edge 21B (as shown in FIG. 1) of the blade 20 is being sharpened, the user pivots the abrasive surface 51, using the pivot structure 55, to the appropriate angle relative to the edge 21 of the blade 20.

The carriage 50 also contains a means for interacting with the impression of the contour of the blade 20 defined by the sheets 63 of the guide 60. In one embodiment, the means for interacting with the impression is at least one wheel extension 56A, 56B vertically connected on a bottom surface of the mounting plate 50. In a preferred embodiment, two wheel extensions 56A, 56B are vertically connected to the bottom surface of the mounting plate 50. The wheel extensions 56A, 56B have a sufficient length to contact an outer edge 63A of the sheets 63. It is contemplated that a means other than wheel extensions 56A, 56B, such as magnetic posts or rollers, may track along the sheets 63.

Figure 5:
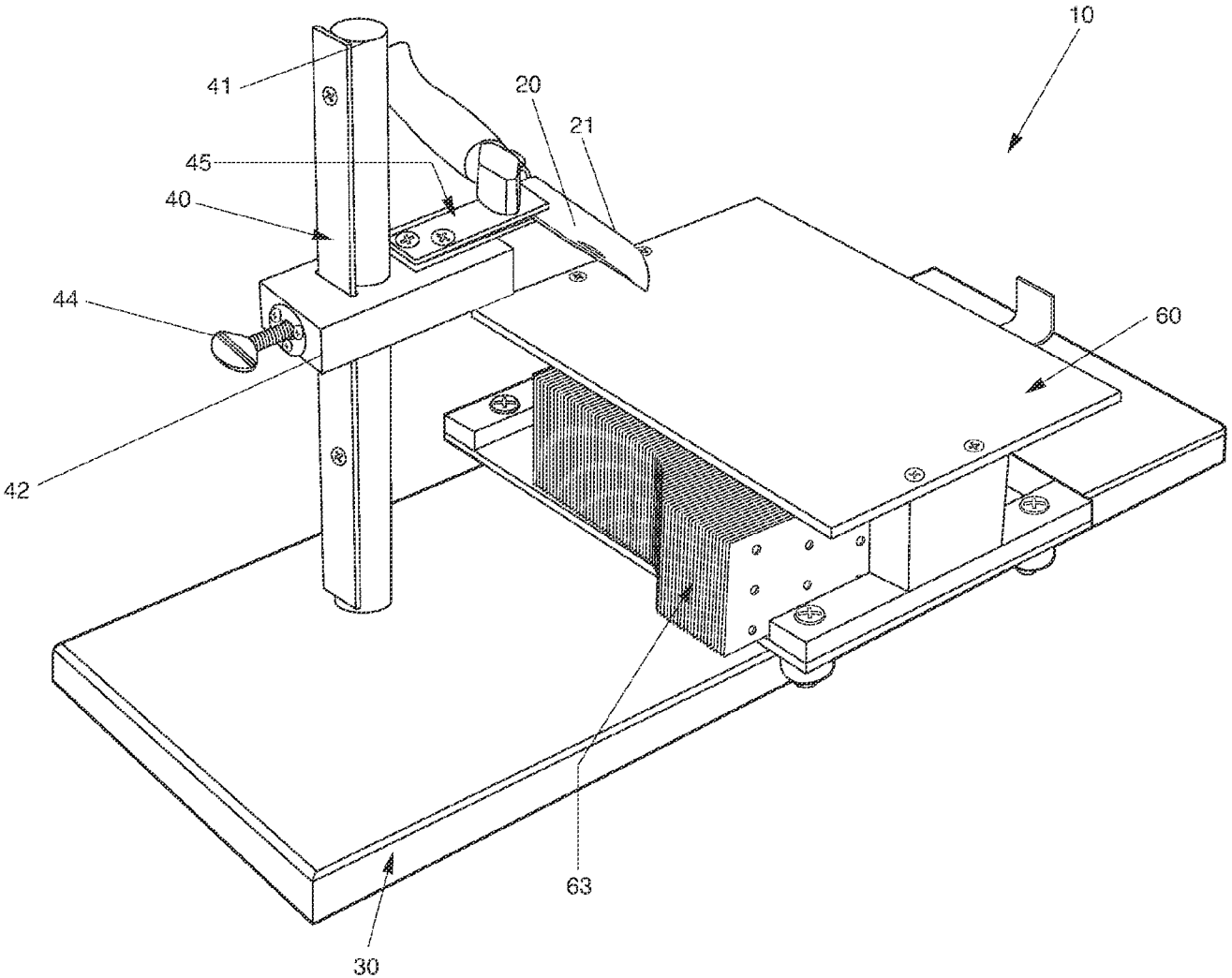
FIG. 5 is a front perspective view of the blade sharpening device in FIG. 1 without the carriage and after an impression of the blade is formed within the sheets of guide.

Now referring to FIGS. 3-7, the blade sharpening device 10 is shown in operation. Now referring to FIG. 3, the blade 20 is horizontally secured on the blade mount 45 and the vertical stabilizer 42 adjusts downward along the post 41 into a position opposite the sheets 63 of the guide 60. The sheets 63 are reset into their original position using a reset tool 64. Now referring to FIG. 4, the guide 60 is moved along the base 30 until the sheets 63 contact the edge 21 of the blade 20. By further moving the guide 60 horizontally along the X axis, the sheets 63 define the contour of the blade 20 thus creating the impression of the contour of the blade 20 along the sheets 63. After the impression of the contour of the blade 20 is transferred to the sheets 63, the sheets 63 are secured in place by the vice screw 64 (FIG. 5).

Now referring to FIG. 5, the vertical stabilizer 42 adjusts upward into a position above the guide 60 to allow the carriage 50 to be placed upon the top plate 60A. Now referring to FIG. 6, the carriage 50 is subsequently placed upon the top plate 60A of the guide 60 for slidable movement. The angle of the abrasive surface 51 is adjusted by rotating the pivot structure 55 according to the edge 21 of the blade 20 required. The vertical stabilizer 42 is positioned downward to a position where the edge 21 of the blade 20 contacts the abrasive surface 51. Once the abrasive surface 51 is in position against the edge 21 of the blade 20, the vertical stabilizer 42 is fixed into position by tightening the screw 44 against the post 40. In addition, the scale 70 is zeroed when the blade 20 contacts the abrasive surface 51. By moving the abrasive surface 51 to the blade 20, it measures how many grams of force you need to sharpen the blade 20. After zeroing the scale 70, the vertical stabilizer 42 is provided with a sufficient level of force in the proper direction. Consequently, the blade edge 21 is pushed further against the abrasive surface 51. If the blade 20 is dull after sharpening, more force can be applied to the blade 20 by use of the scale 70, 71 while taking notice not to apply to much force that may cause the blade 20 to overheat.

Figure 6:
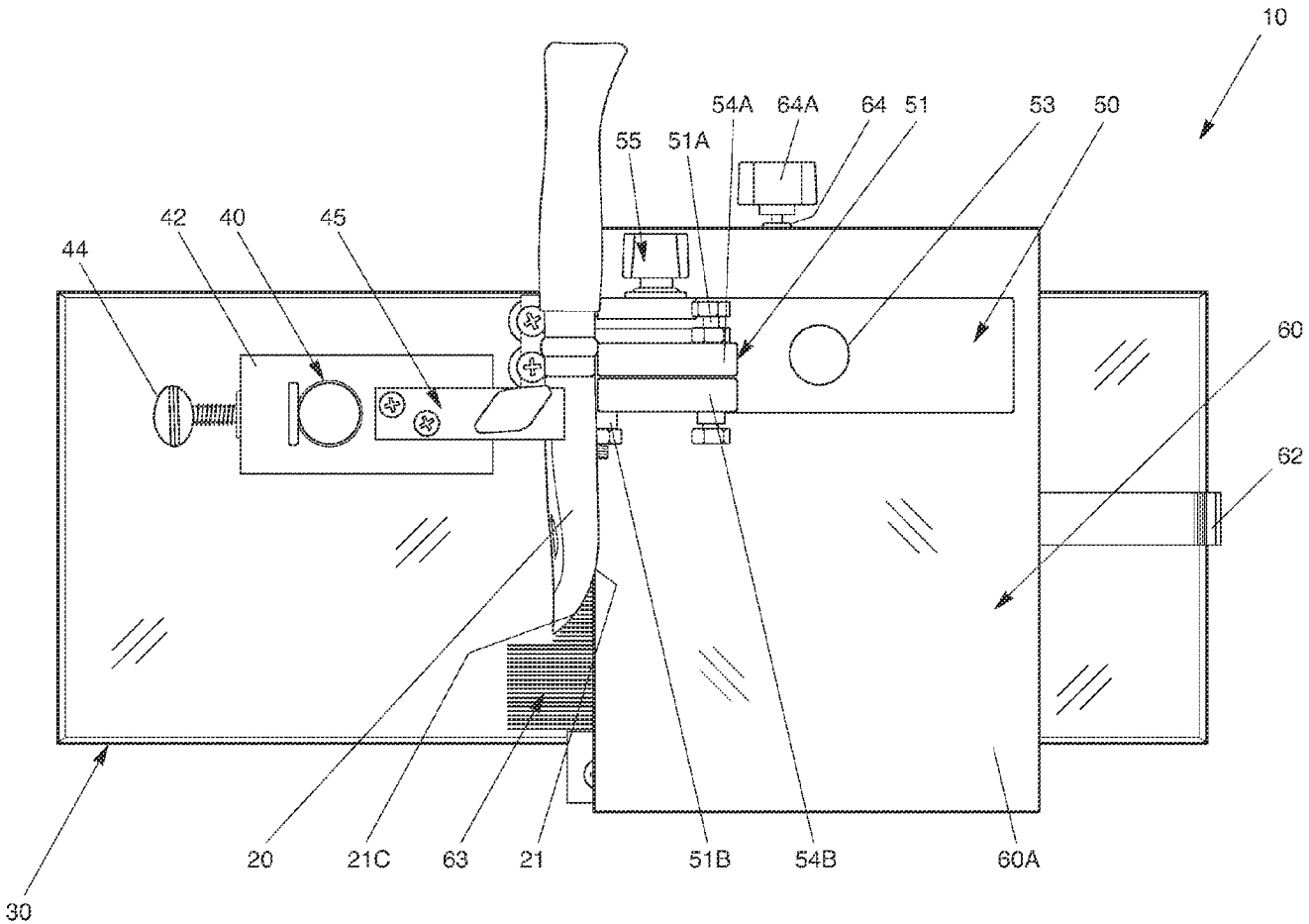
FIG. 6 is a top view of the blade sharpening device in FIG. 1 with the carriage sharpening a beginning portion of the blade.
Figure 7:
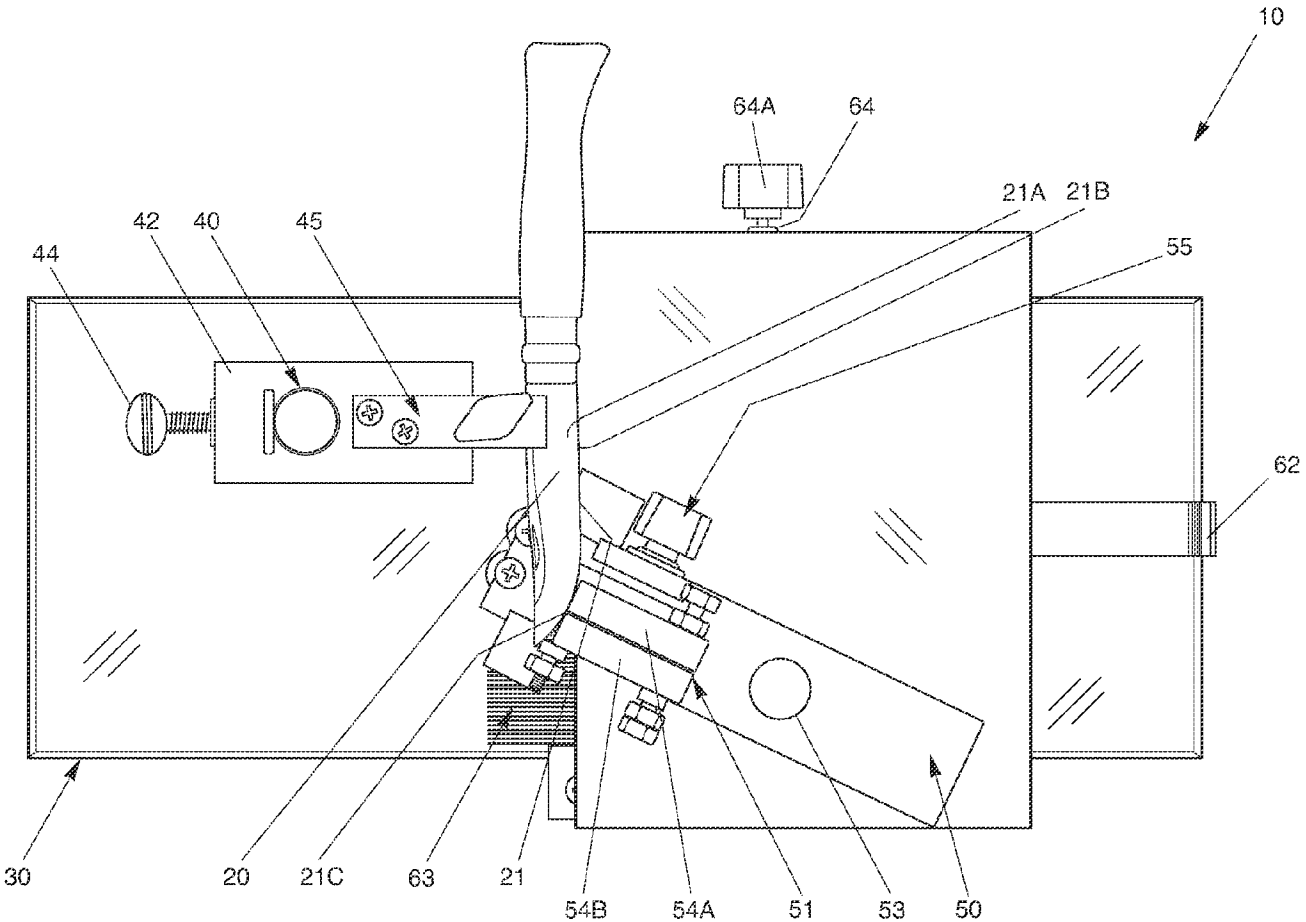
FIG. 7 is a top view of the blade sharpening device in FIG. 1 with the carriage sharpening a curved portion of the blade.

Now referring to FIGS. 6 and 7, the bottom edge 21B of the blade 20 is sharpened by tracking the carriage 50 along the sheets 63 defining the contour of the blade 20, also known as the sharpening path. By tracking the carriage 50 along the sheets 63 of the guide 60, the edge 21 of the blade 20 is sharpened along a defined sharpening path similar to the contour of the blade 20. After sharpening the bottom edge 21B of the blade 20, the abrasive surface 51 is pivoted to contact the top edge 21A of the blade for sharpening similarly to the bottom edge 21B. By using the sharpening path, the edge 21 of the blade 20 is sharpened with a consistent contour, especially in the curved portion 21C of the blade 20, and a desired angle of the edge 21 based upon the setting of the angle of the abrasive surface 51. Upon the sharpening of the blade 20, the blade 20 is removed from the blade mount 45.

In a second embodiment of the present invention, the blade sharpening device 10 contains a base 30, guide 60, and carriage 50. The guide 60 defines a preformed sharpening path, as opposed to creating an impression during the sharpening, substantially aligning with the contour of the blade 20. The preformed sharpening path is created by taking an impression of the contour of the blade 20 during the manufacturing process of the blade sharpening device 10. The carriage 50 sharpens the edge 21 of the blade 20 with the abrasive surface 51 while tracking the preformed sharpening path of the guide 60. The angle of the abrasive surface 51 may also be adjusted according to markings on the pivot structure 55 for the specific knife or blade 20. It should be noted that multiple preformed sharpening paths of the guide 60 may be created that are suitable for a set of knives or blades.

During operation of the second embodiment, the user selects a preformed sharpening path on the guide 60 and angle of the abrasive surface 51 according to the requirements of specific knife blade 20. For example, a manufacturer of a set knives or blades may provide a preformed sharpening path for each of the knives within the set. Each knife may have a number or other symbol associated with the knife to correspond to a particular setting on the blade sharpening device—corresponding to the angle of the abrasive surface 51 or the preformed sharpening path of the guide 60. Subsequently, the carriage 50 tracks the preformed sharpening path while utilizing the specific angle optimal for that specific knife or blade setting as recommended by the manufacturer of the knife or blade set. While the carriage 50 tracks the preformed sharpening path of the guide 60, the abrasive surface 51 sharpens the edge 21 of the blade 20 to provide a consistent contour and uniform edge 21 along the blade 20.

Therefore, the present invention provides a blade sharpening device 10 that requires less skill and provides a consistent contour and more uniform edge 21 of a blade 20 than prior art blade sharpeners. The blade sharpening device 10 includes a unique construction that has a guide 60 capable of receiving an impression of the contour of the blade 20 before or after the manufacturing of the device 10. The carriage 50 contains an abrasive surface 51 and tracks along the guide 60 while sharpening the edge 21 of the blade 20. Together, the guide 60 and carriage 50 direct the movement and angle of the abrasive surface 51 along the contour of the blade 20 for a uniform sharpening of the edge thereof.

It would be appreciated by those skilled in the art that various changes and modifications can be made to the illustrated embodiments without departing from the spirit of the present invention. All such modifications and changes are intended to be covered by the appended claims and the present invention.

What is claimed is:

1. A blade sharpening device, comprising:

a base;

a blade holder attached to the base for securing the blade while being sharpened;

a guide slidably movable relative to the base, said guide including a material that receives an impression defining a blade contour;

a carriage containing a means for interacting with the material of the guide to define a sharpening path substantially aligning with the blade contour, said carriage including an abrasive surface for sharpening the blade;

whereby said guide and carriage direct the movement of the abrasive surface along the contour of the blade for a uniform sharpening of an edge thereof.

2. The blade sharpening device of claim 1, wherein the base has a rectangular shape.

3. The blade sharpening device of claim 1, wherein the guide is in the shape of a box with top and bottom plates.

4. The blade sharpening device of claim 3, further comprising:

a series of wheels attached to the bottom plate for contacting at least one side of the base.

5. The blade sharpening device of claim 3, further comprising:

a handle connected to the box to facilitate slidable movement of the guide relative to the base.

6. The blade sharpening device of claim 3, wherein the guide contains metal plates capable of receiving an impression defining a blade contour.

7. The blade sharpening device of claim 3, wherein the guide contains rods capable of receiving an impression of the blade defining a blade contour.

8. The blade sharpening device of claim 3, further comprising: a knob attached to the box for adjusting tension of sheets positioned within the box.

9. The blade sharpening device of claim 1, wherein the blade holder contains a post connected to the top of the base.

10. The blade sharpening device of claim 9, wherein the post has a vertical stabilizer for positioning the blade relative to the guide and the carriage.

11. The blade sharpening device of claim 10, wherein the vertical stabilizer has a means for securing the vertical stabilizer in a fixed position relative to the post.

12. The blade sharpening device of claim 10, wherein the vertical stabilizer has a blade mount for securing the blade to the vertical stabilizer.

13. The blade sharpening device of claim 1, wherein the carriage contains a polishing surface for contacting the blade.

14. The blade sharpening device of claim 1, wherein the carriage contains a pivot structure to position the abrasive surface relative to the blade.

15. The blade sharpening device of claim 14, wherein the means for interacting with the material of the guide are wheels for contacting the material along a defined path of the contour of the blade.

16. A blade sharpening device, comprising:

a base;

a blade holder attached to the base for securing the blade while being sharpened;

a guide slidably movable relative to the base, said guide including a material that defines a preformed sharpening path substantially aligning with a contour of a blade;

a carriage containing a means for interacting with the material of the guide to define the preformed sharpening path substantially aligning with the blade contour, said carriage having an abrasive surface for sharpening the blade;

whereby said guide and carriage direct the movement of the abrasive surface along the contour of the blade for a uniform sharpening of an edge thereof.

17. A blade sharpening device, comprising:

a base;

a guide slidably movable relative to the base, said guide including a material that receives an impression of a blade defining a blade contour;

a carriage containing a means for interacting with the material of the guide to define a sharpening path substantially aligning with the blade contour, said carriage having an abrasive surface for sharpening the blade;

whereby said guide and carriage direct the movement of the abrasive surface along the contour of the blade for a uniform sharpening of an edge thereof.

* * * * *